US007135812B2

(12) United States Patent
Yoshinari et al.

(10) Patent No.: US 7,135,812 B2
(45) Date of Patent: Nov. 14, 2006

(54) PARTITION-WALL STRUCTURE FOR PLASMA DISPLAY PANEL AND PLASMA DISPLAY PANEL

(75) Inventors: Masaki Yoshinari, Yamanashi-ken (JP); Ryouji Inoue, Tottori-ken (JP)

(73) Assignee: Pioneer Corporation, Tokyo (JP)

( * ) Notice: Subject to any disclaimer, the term of this patent is extended or adjusted under 35 U.S.C. 154(b) by 224 days.

(21) Appl. No.: 10/682,434

(22) Filed: Oct. 10, 2003

(65) Prior Publication Data

US 2004/0075376 A1 Apr. 22, 2004

(30) Foreign Application Priority Data

Oct. 16, 2002 (JP) ..... 2002-301541

(51) Int. Cl.
*H01J 1/88* (2006.01)
*H01J 17/49* (2006.01)

(52) U.S. Cl. ..... 313/292; 313/582

(58) Field of Classification Search ..... 313/583
See application file for complete search history.

(56) References Cited

U.S. PATENT DOCUMENTS 6,492,770 B1 * 12/2002 Amemiya et al. ..... 313/586
6,577,062 B1 * 6/2003 Itokawa et al. ..... 313/582
6,603,260 B1 * 8/2003 Kim et al. ..... 313/562
2002/0171361 A1 * 11/2002 Akiba ..... 313/582

FOREIGN PATENT DOCUMENTS

| | | |
|---|---|---|
| JP | 05-159706 | 6/1993 |
| JP | 05-334956 | 12/1993 |
| JP | 06-267428 | 9/1994 |
| JP | 2000-195431 | 7/2000 |

OTHER PUBLICATIONS

European Search Report dated Sep. 15, 2005.

* cited by examiner

*Primary Examiner*—Mariceli Santiago
*Assistant Examiner*—Anne M Hines
(74) *Attorney, Agent, or Firm*—McGinn IP Law Group, PLLC

(57) ABSTRACT

A metal-made partition wall 16 has an external surface covered by an insulation layer 16*a*, and transverse walls 16A each extending in the row direction to define the partition between discharge cells C adjacent to each other in the column direction between a front glass substrate 1 and a back glass substrate 4 of a plasma display panel. A groove 16Aa formed in at least one of the front-facing face and the back face of the transverse wall 16A.

12 Claims, 8 Drawing Sheets

SECTION V - V

SECTION V1-V1

SECTION W1 - W1

SECTION V2 - V2

PARTITION-WALL STRUCTURE FOR PLASMA DISPLAY PANEL AND PLASMA DISPLAY PANEL

BACKGROUND OF THE INVENTION

1. Field of the Invention

This invention relates to partition-wall structure for plasma display panels and a plasma display panel having the partition-wall structure.

The present application claims priority from Japanese Application No. 2002-301541, the disclosure of which is incorporated herein by reference.

2. Description of the Related Art

FIG. 1 is a schematic front view illustrating cell structure of a conventional plasma display panel (hereinafter referred to as "PDP"), and FIG. 2 is a sectional view taken along the V—V line in FIG. 1.

The conventional PDP includes a front glass substrate 1, serving as the display screen of panel, having on its back surface, in order, a plurality of row electrode pairs (X, Y), a dielectric layer 2 covering the row electrode pairs (X, Y), and an MgO-made protective layer 3 covering the back surface of the dielectric layer 2.

Each of the row electrodes X and Y is constituted of transparent electrodes Xa or Ya each formed of a transparent conductive film of a larger width made of ITO (Indium Tin Oxide) or the like, and a bus electrode Xb or Yb formed of a metal film of a smaller width assisting the electrical conductivity of the corresponding transparent electrodes.

The row electrodes X and Y are arranged in alternate positions in the column direction such that their transparent electrodes Xa and Ya face each other with a discharge gap g in between. Each of the row electrode pairs (X, Y) forms a display line L in the matrix display.

The front glass substrate 1 is placed opposite a back glass substrate 4 with a discharge-gas-filled discharge space in between. The back glass substrate 4 is provided thereon with: a plurality of column electrodes D regularly arranged and each extending in a direction at right angles to the row electrode pairs (X, Y); a column-electrode protective layer 5 covering the column electrodes D; a partition wall 6 formed in a pattern, which will be described later, for partitioning the discharge space; and red-, green- and blue-colored phosphor layers 7 each formed on the side faces of the partition walls 6 and the column-electrode protective layer 5.

The partition wall 6 is constituted of transverse walls 6A and vertical walls 6B. Each of the transverse walls 6A extends in the row direction in a position opposite the bus electrodes Xb and Yb backing on each other in between the respective row electrode pairs (X, Y) positioned alongside each other. Each of the vertical walls 6B extends in the column direction in a position opposite to the midpoint between the adjacent transparent electrodes Xa and between the adjacent transparent electrodes Ya which are arranged at regular intervals along the corresponding bus electrodes Xb and Yb of the respective row electrodes X, Y. The partition wall 6 is thus shaped in a grid pattern of the transverse walls 6A and the vertical walls 6B so as to define discharge cells C in a one-to-one correspondence with pairs of the transparent electrodes Xa and Ya opposed to each other with the discharge gap g in between in each row electrode pair (X, Y).

The partition wall 6 for partitioning the discharge space into the discharge cells C is conventionally formed of electric insulation materials. For example, a partition-wall material such as a glass paste is coated in a thick film on the back glass substrate 4, then dried. After that, the resulting partition-wall materials is cut into a grid pattern by a sandblasting process using a mask of a predetermined pattern, and then is burned to form the partition wall 6.

The conventional method of forming the partition wall by use of sandblasting has the complicated manufacturing process and therefore gives rise to the problem of a low level of productivity and increased manufacturing costs.

For this reason, instead of the conventional partition wall obtained by forming the insulation material, using a metal-made partition wall covered by an insulation layer has been studied.

However, using the metallic partition wall in the PDP gives rise to the problem of an increase in the electrostatic capacity in the panel and an increase in reactive power associated therewith, leading to an increase in electrical power consumption. Hence, the use of metallic partition wall is not yet commercially practical at present.

SUMMARY OF THE INVENTION

The present invention has been made to solve the problems associated with the conventional PDP as described above.

It therefore is an object of the present invention to allow the commercialization of PDPs using a metallic partition wall.

To attain the above object, a partition wall for a PDP according to a first aspect of the present invention is made of metal and has an external surface covered by an insulation layer, and transverse walls each extending in a row direction to define a partition between unit light-emission areas adjacent to each other between two substrates of the PDP in a column direction, and advantageously has a groove portion formed in at least one of a front-facing face and a back face of the transverse wall.

When the partition wall for the PDP according to the first aspect is used for partitioning a discharge space defined between a front glass substrate and a back substrate of a PDP, because the grooves are formed in the transverse walls forming part of the partition wall, electrostatic capacity which is produced in a non-display area of a PDP when a metal-made partition wall is used is reduced. Hence, the occurrence of reactive power during driving of the PDP is suppressed.

In particular, the use of the partition wall of the present invention offers a reduction in the electrostatic capacity produced between the row electrode on the front glass substrate and the column electrode on the back glass substrate which are opposite each other with the discharge space in between to allow for generation of an addressing discharge, and therefore reactive power occurring when the addressing discharge is generated is effectively suppressed.

The structure of the partition wall according to the present invention offers the applicability of a metal-made partition wall to a PDP.

Further, to attain the aforementioned object, a partition wall for a PDP according to a second aspect of the present invention is made of metal, and has an external surface covered by an insulation layer, and transverse walls each extending in a row direction to define a partition between unit light-emission areas adjacent to each other between two substrates of the PDP in a column direction, and advantageously has a belt-shaped dielectric extending in the row direction and integrally mounted on the transverse wall.

When the partition wall for the PDP according to the second aspect is used for partitioning a discharge space defined between a front glass substrate and a back substrate of a PDP, because the dielectrics are mounted integrally on the transverse walls forming part of the partition wall, a reduction in the electrostatic capacity produced in a non-display area of a PDP when a metal-made partition wall is used is achieved. Hence, the occurrence of reactive power during driving of the PDP is suppressed.

In particular a reduction in the electrostatic capacity produced between the row electrode on the front glass substrate and the column electrode on the back glass substrate which are opposite each other with the discharge space in between to allow for generation of an addressing discharge is achieved, reactive power occurring when the addressing discharge is generated is effectively suppressed.

The structure of the partition wall according to the present invention offers the applicability of a metal-made partition wall to a PDP.

Further, to attain the aforementioned object, a PDP according to a third aspect of the present invention has a feature that a partition wall provided between two substrates is made of metal, and has an external surface covered by an insulation layer, a transverse wall for defining a partition between unit light-emission areas adjacent to each other in a column direction, and a groove portion formed in at least one of a front-facing face and a back face of the transverse wall.

With the PDP according to the third aspect, because the grooves are formed in the transverse walls forming part of the partition wall partitioning the discharge space into the unit light-emission areas between the front glass substrate and the back glass substrate, the electrostatic capacity produced in a non-display area of a PDP when a metal-made partition wall is used is reduced. Hence, the occurrence of reactive power during driving of the PDP is suppressed.

In particular, a reduction in the electrostatic capacity produced between the row electrode on the front glass substrate and the column electrode on the back glass substrate which are opposite each other with the discharge space in between to allow for generation of an addressing discharge is achieved, thereby effectively suppressing reactive power occurring when the addressing discharge is generated.

Still further, to attain the aforementioned object, a PDP according to a fourth aspect of the present invention has a feature that a partition wall provided between two substrates is made of metal, and has an external surface covered by an insulation layer, a transverse wall for defining a partition between unit light-emission areas adjacent to each other in a column direction, and a belt-shaped dielectric extending in a row direction and integrally mounted on the transverse wall.

With the PDP according to the fourth aspect, because the belt-shaped dielectrics each extending in the row direction are mounted integrally on the partition wall partitioning the discharge space into the unit light-emission areas between the front glass substrate and the back glass substrate, the electrostatic capacity produced in a non-display area of a PDP when a metal-made partition wall is used is reduced. Hence, the occurrence of reactive power during driving of the PDP is suppressed.

In particular, a reduction in the electrostatic capacity produced between the row electrode on the front glass substrate and the column electrode on the back glass substrate which are opposite each other with the discharge space in between to allow for generation of an addressing discharge is achieved, thereby effectively suppressing reactive power occurring when the addressing discharge is generated.

These and other objects and features of the present invention will become more apparent from the following detailed description with reference to the accompanying drawings.

DETAILED DESCRIPTION OF THE PREFERRED EMBODIMENTS

Preferred embodiments according to the present invention will be described below with reference to the accompanying drawings.

Figure 1:
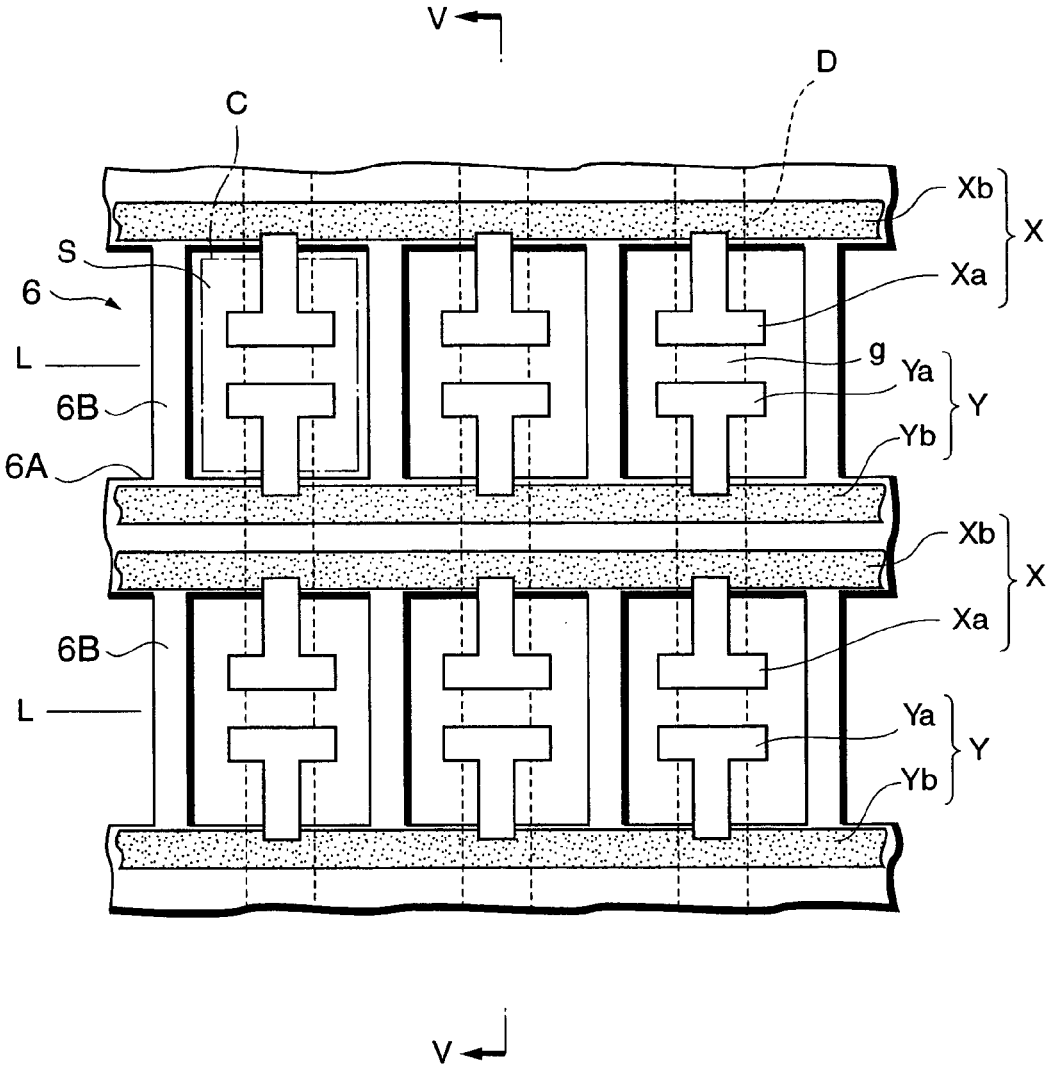
Fig.1 PRIOR ART
FIG. 1 is a front view illustrating the structure of a conventional plasma display panel.
Figure 2:
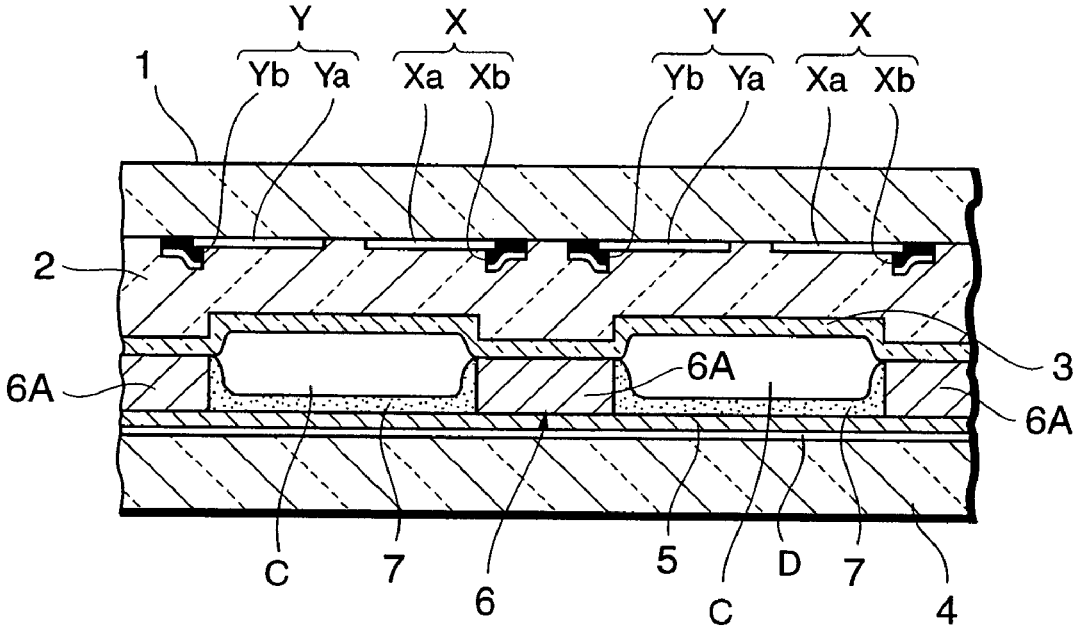
Fig.2 PRIOR ART
FIG. 2 is a sectional view taken along the V—V line in FIG. 1.
Figure 3:
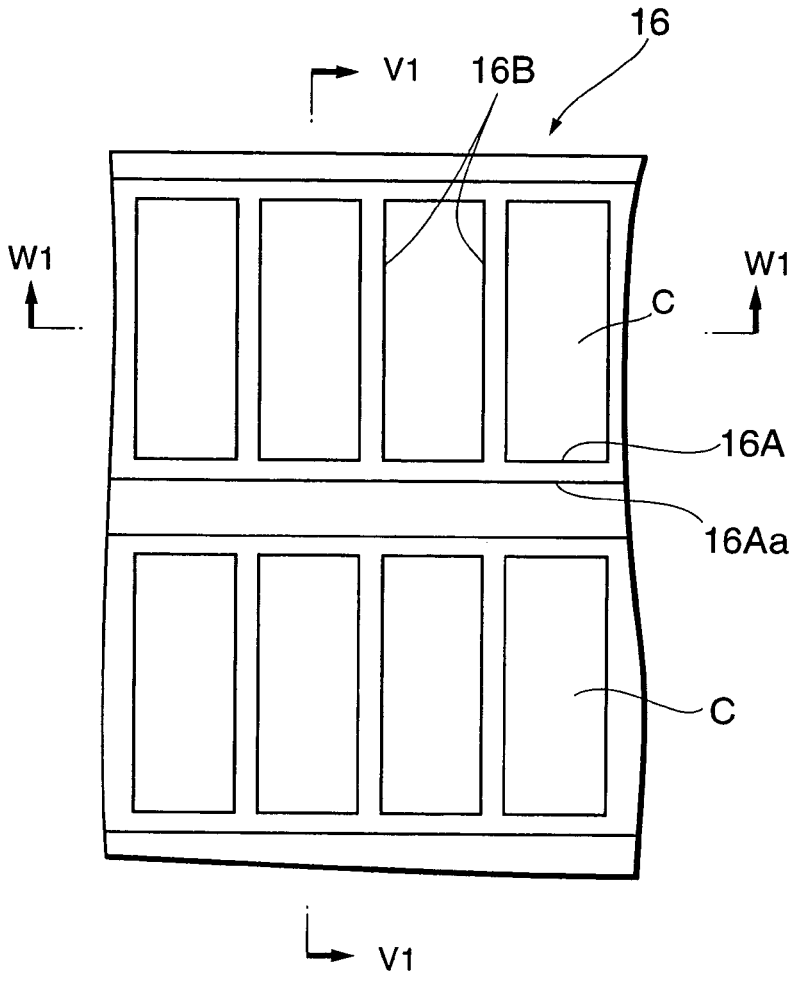
FIG. 3 is a front view illustrating a first embodiment of a partition wall of a plasma display panel according to the present invention.
Figure 4:
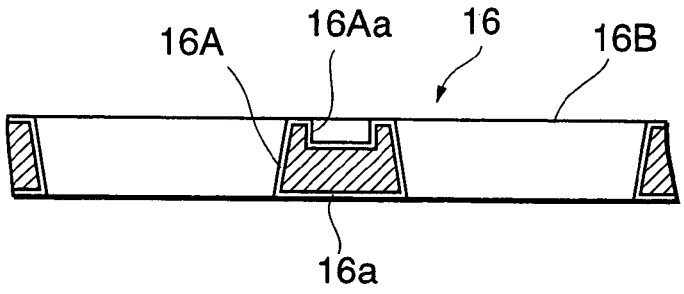
FIG. 4 is a sectional view taken along the V1—V1 line in FIG. 3.
Figure 5:
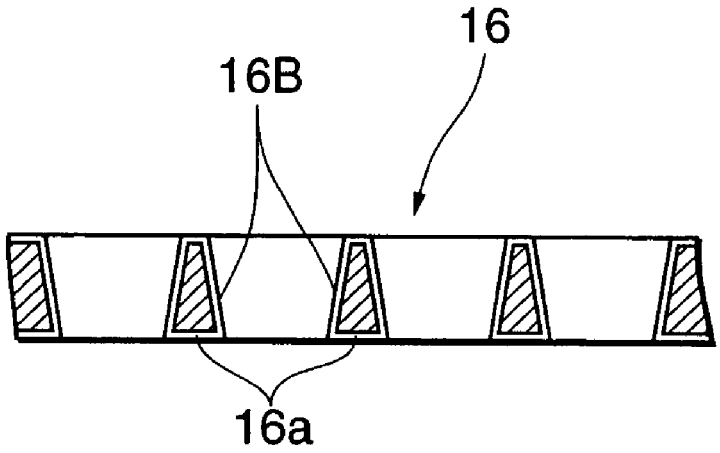
FIG. 5 is a sectional view taken along the W1—W1 line in FIG. 3.

FIG. 3 is a front view illustrating a first embodiment of a partition wall of a plasma display panel (hereinafter referred to as "PDP") according to the present invention. FIG. 4 is a sectional view taken along the V1—V1 line in FIG. 3. FIG. 5 is a sectional view taken along the W1—W1 line in FIG. 3.

The partition wall 16 of the PDP in the first embodiment is shaped in a grid pattern by metal-made transverse walls 16A arranged at regular intervals in a column direction (the vertical direction of FIG. 3) and each extending in a row direction (the right-left direction in FIG. 3), and metal-made vertical walls 16B arranged at regular intervals in the row direction and each extending in the column direction.

A groove 16Aa extending in the row direction is formed in a central portion of the front-facing face (the upper face in FIG. 4) of the transverse wall 16A of the partition wall 16.

In the first embodiment, the groove 16Aa is shaped into a rectangular cross section, but the groove can be formed into various shapes in cross section such as semi-circles or triangles.

The groove 16Aa may be intermittently formed in the row direction.

The entire surface of the partition wall 16 is covered by an insulation layer 16*a*.

Using the partition wall 16 for partitioning the discharge space defined between the front glass substrate and the back glass substrate of the PDP into the discharge cells makes it possible to reduce the electrostatic capacity produced in a non-display area of a PDP using a metal-made partition wall, thereby minimizing reactive power occurring during driving of the PDP.

In particular, when an addressing discharge (for selecting the discharge cells to emit light) is generated in the discharge space between the row electrode on the front glass substrate and the column electrode on the back glass substrate, the electrostatic capacity produced between the row electrode and the column electrode is reduced to allow effective control over reactive power when generating the addressing discharge.

Figure 6:
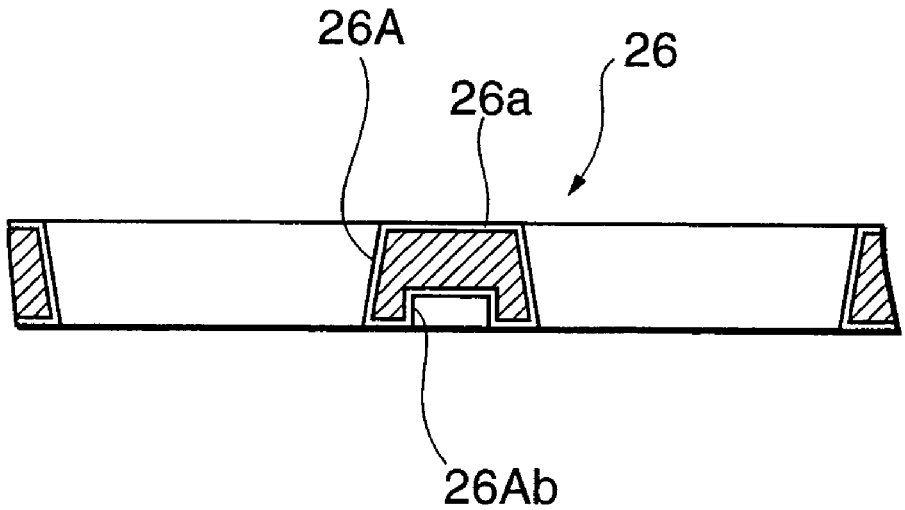
FIG. 6 is a sectional view illustrating a second embodiment of a partition wall of a plasma display panel according to the present invention.

FIG. 6 is a sectional view illustrating a second embodiment of a partition wall of a PDP according to the present invention, which is taken along the line as is the case in FIG. 4 of the first embodiment.

The first embodiment describes the groove 16Aa formed in the front-facing face of the transverse wall 16A, whereas a groove 26Ab in the second embodiment extends in the row direction in a central portion of a back face (the underside in FIG. 6) of a transverse wall 26A of a partition wall 26 covered by an insulation layer 26*a* and formed into a grid pattern.

The groove 26Ab is rectangular in cross section as illustrated in FIG. 6, but any groove of various shapes in cross section, such as semi-circles or triangles, can be used.

The groove 26Ab may be intermittently formed in the row direction.

When the partition wall 26 in the second embodiment is used for partitioning the discharge space defined between the front glass substrate and the back glass substrate of the PDP into the discharge cells, as in the case of the first embodiment, the electrostatic capacity which is produced in a non-display area of a PDP using a metal-made partition wall is reduced. Hence, the occurrence of reactive power during driving of the PDP is suppressed.

Figure 7:
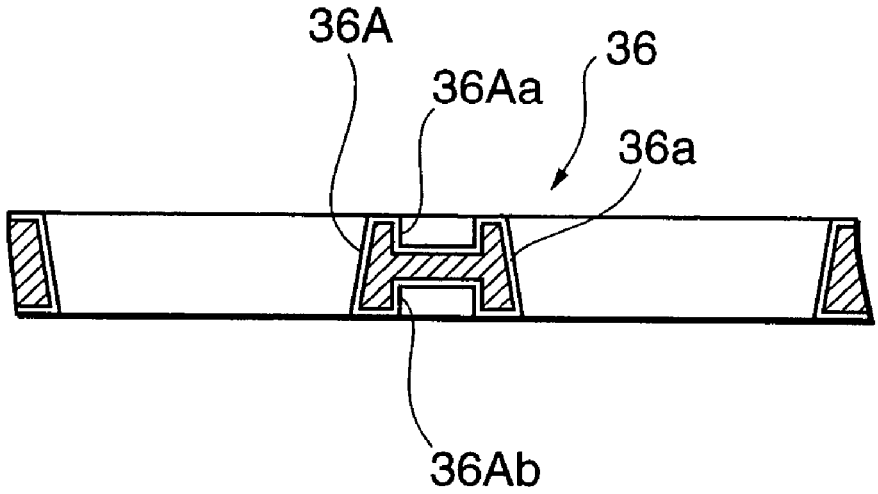
FIG. 7 is a sectional view illustrating a third embodiment of a partition wall of a plasma display panel according to the present invention.

FIG. 7 is a sectional view illustrating a third embodiment of a partition wall of a PDP according to the present invention, which is taken along the line as is the case in FIG. 4 of the first embodiment.

In the third embodiment, a groove 36Aa extends in the row direction in a central portion of the front-facing face of a transverse wall 36A of a partition wall 36 formed in a grid pattern and covered by an insulation layer 36*a*. Further, a groove 36Ab extends in the row direction in a central portion of the back face of the transverse wall 36A.

The grooves 36Aa and 36Ab are rectangular in cross section as illustrated in FIG. 7, but any groove of various shapes in cross section, such as semi-circles or triangles, can be used.

Using the partition wall 36 in the third embodiment for partitioning the discharge space defined between the front glass substrate and the back glass substrate of the PDP into the discharge cells makes it possible to further reduce the electrostatic capacity which is produced in a non-display area of a PDP using a metal-made partition wall, as compared with the cases of the first and second embodiments. This in turn makes it possible to significantly suppress reactive power occurring during driving of the PDP.

Figure 8:
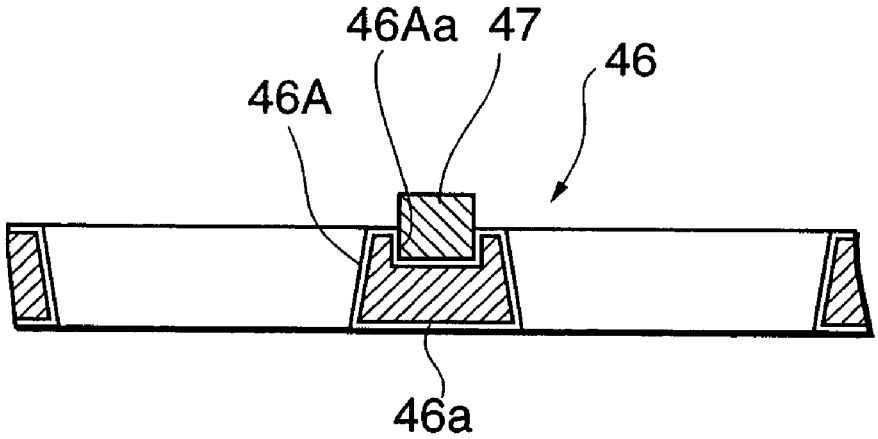
FIG. 8 is a sectional view illustrating a fourth embodiment of a partition wall of a plasma display panel according to the present invention.

FIG. 8 is a sectional view illustrating a fourth embodiment of a partition wall of a PDP according to the present invention, which is taken along the line as is the case in FIG. 4 of the first embodiment.

As in the case of the first embodiment, a partition wall 46 in the fourth embodiment is a metal-made partition wall formed in a grid pattern, and has a groove 46Aa extending in the row direction in a central portion of the front-facing face of a transverse wall 46A.

Into the groove 46Aa a rod-shaped dielectric 47 is fitted such that the top section thereof protrudes from the front-facing face of the transverse wall 46A.

In the fourth embodiment, the groove 46Aa is formed in a rectangular cross section, and also the dielectric 47 is shaped in a rectangular cross section in accordance with the cross sectional shape of the groove 46Aa, but any groove and dielectric of various shapes in cross section, such as semi-circles or triangles, can be used.

The entire surface of the metallic portion of the partition wall 46 is covered by an insulation layer 46*a*.

When the partition wall 46 in the fourth embodiment is used for partitioning the discharge space defined between the front glass substrate and the back glass substrate of the PDP into the discharge cells, the dielectric 47 fitted into the groove 46Aa allows a further reduction in the electrostatic capacity produced in a non-display area of a PDP as compared with the case of the first embodiment, thereby making it possible to substantially suppress reactive power occurring during driving of the PDP.

Figure 9:
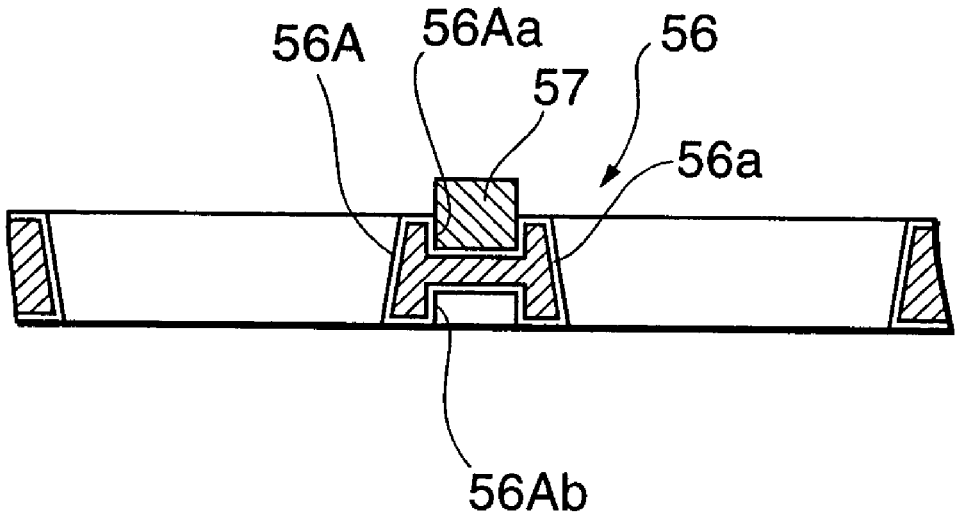
FIG. 9 is a sectional view illustrating a fifth embodiment of a partition wall of a plasma display panel according to the present invention.

FIG. 9 is a sectional view illustrating a fifth embodiment of a partition wall of a PDP according to the present invention, which is taken along the line as is the case in FIG. 4 of the first embodiment.

A partition wall 56 in the fifth embodiment is a metal-made partition wall formed in a grid pattern as in the case of the fourth embodiment. A groove 56Aa extending in the row direction is formed in a central portion of the front-facing face of a transverse wall 56A. Then, a rod-shaped dielectric 57 is fitted into the groove 56Aa with the top portion protruding from the front-facing face of the transverse wall 56A.

Further, a groove 56Ab extending in the row direction is formed in a central portion of the back face of the transverse wall 56A.

In the fifth embodiment, the grooves 56Aa and 56Ab are shaped in a rectangular cross section, and also the dielectric 57 is shaped in a rectangular cross section in accordance with the cross sectional shape of the groove 56Aa, but any groove and dielectric of various shapes in cross section, such as a semi-circle or a triangle, can be employed.

The entire surface of the metallic portion of the partition wall 56 is covered by an insulation layer 56*a*.

When the partition wall 56 in the fifth embodiment is used for partitioning the discharge space defined between the front glass substrate and the back glass substrate of the PDP into the discharge cells, because of the formation of the grooves 56Ab in the back faces of the transverse walls 56A, it is possible to further reduce electrostatic capacity produced in the non-display area of the PDP as compared with the case of the fourth embodiment. Hence, the occurrence of reactive power during driving of the PDP is subsequently suppressed.

Figure 10:
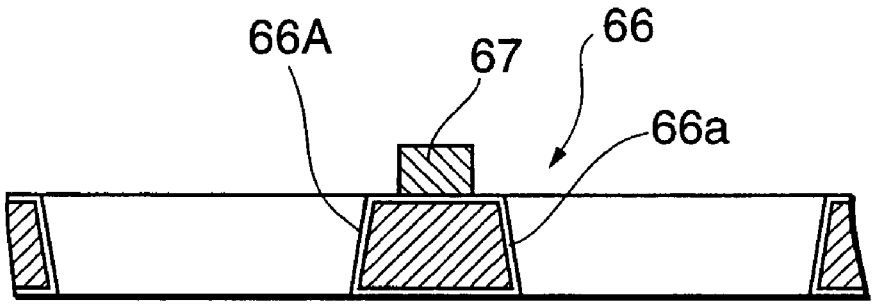
FIG. 10 is a sectional view illustrating a sixth embodiment of a partition wall of a plasma display panel according to the present invention.

FIG. 10 is a sectional view illustrating a sixth embodiment of a partition wall of a PDP according to the present invention, which is taken along the line as is the case in FIG. 4 of the first embodiment.

A partition wall 66 in the sixth embodiment is formed of metal-made materials into a grid pattern as in the case of the first embodiment. A rod-shaped dielectric 67 extending in the row direction is in contact with and secured integrally with the front-facing face of a transverse wall 66A of the partition wall 66.

The sixth embodiment uses the dielectric 67 formed in a rectangular cross section, but any dielectric of various shapes in cross section, such as semi-circles or triangles, can be employed.

The entire surface of the metallic portion of the partition wall 66 is covered by an insulation layer 66*a*.

Because of the integral mounting of the dielectrics 67 on the transverse walls 66A, using the partition wall 66 in the sixth embodiment for partitioning the discharge space defined between the front glass substrate and the back glass substrate of the PDP into the discharge cells allows a reduction in the electrostatic capacity produced in a non-display area of a PDP using a metal-made partition wall. This makes it possible to subsequently suppress reactive power occurring during driving of the PDP.

Figure 11:
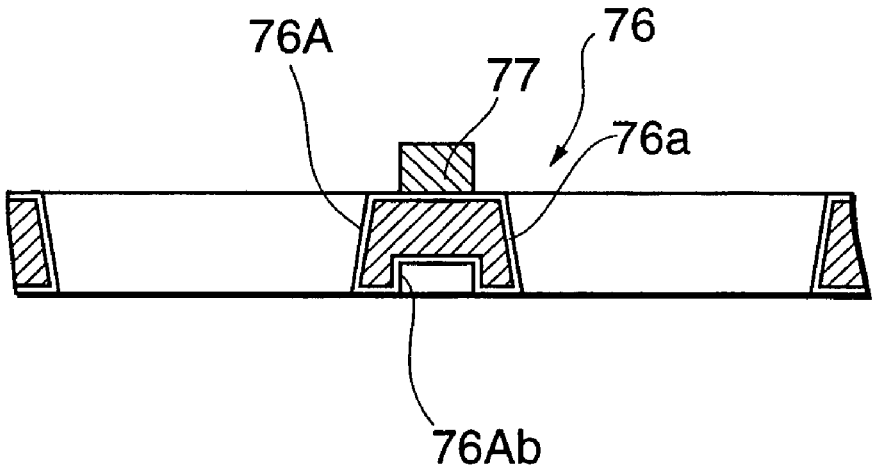
FIG. 11 is a sectional view illustrating a seventh embodiment of a partition wall of a plasma display panel according to the present invention.

FIG. 11 is a sectional view illustrating a seventh embodiment of a partition wall of a PDP according to the present invention, which is taken along the line as is the case of FIG. 4 of the first embodiment.

A partition wall 76 in the seventh embodiment is formed of metallic materials into a grid pattern as in the case of the first embodiment. A rod-shaped dielectric 77 extending in the row direction is in contact with and secured integrally on the front-facing face of a transverse wall 76A of the partition wall 76.

The transverse wall 76A has a groove 76Ab formed in a central portion of the back face to extend in the row direction.

The seventh embodiment uses the rectangular cross-section dielectric 77 and the rectangular cross-section groove 76Ab, but any dielectric and any groove of various shapes in cross section such as semicircles or triangles can be employed.

The entire surface of the metallic portion of the partition wall 76 is covered by an insulation layer 76*a*.

Because the partition wall 76 has the grooves 76Ab formed in the back faces of the transverse walls 76A in addition to the structure of the sixth embodiment, using the partition wall 76 in the seventh embodiment for partitioning the discharge space defined between the front glass substrate and the back glass substrate of the PDP into the discharge cells allows a further reduction in the electrostatic capacity produced in the non-display area of a PDP using a metal-made partition wall. This makes it possible to significantly suppress reactive power occurring during driving of the PDP.

Figure 12:
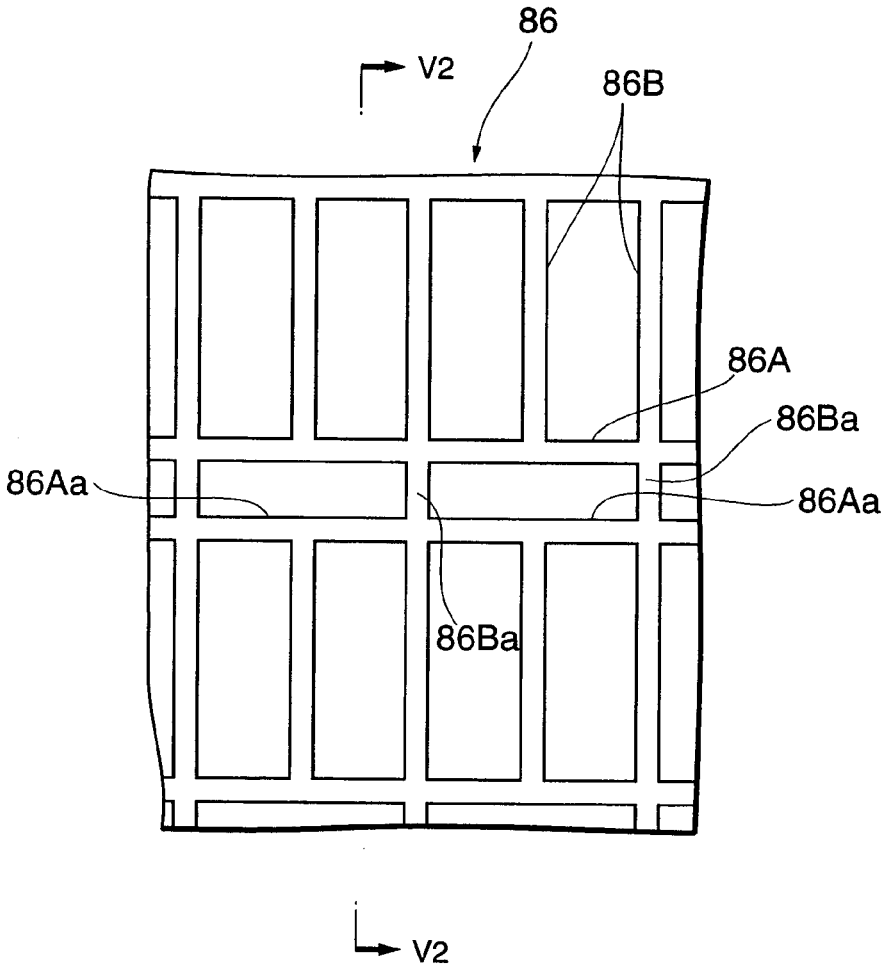
FIG. 12 is a front view illustrating an eighth embodiment of a partition wall of a plasma display panel according to the present invention.
Figure 13:
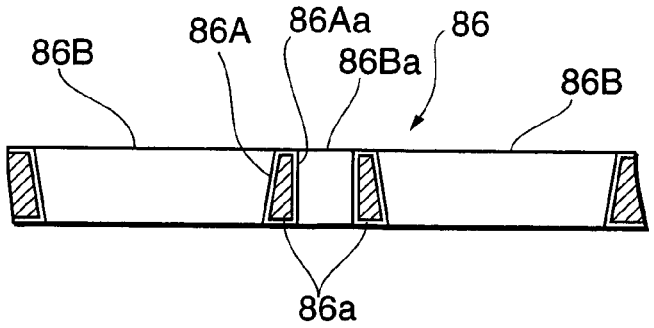
FIG. 13 is a sectional view taken along the V2—V2 line in FIG. 12.

FIG. 12 is a front view illustrating an eighth embodiment of a partition wall of a PDP according to the present invention and FIG. 13 is a sectional view taken along the V2—V2 line in FIG. 12.

A partition wall 86 in the eighth embodiment is formed in a gird pattern by metal-made transverse walls 86A and metal-made vertical walls 86B as in the case of the first embodiment.

The transverse wall 86A has slots 86Aa formed at regular intervals along the row direction. Each of the slots 86Aa has a row-direction width corresponding to the row-direction length of the two discharge cells and passes through the transverse wall from front to back. The two adjacent slots 86Aa are blocked from each other by a vertical wall portion 86Ba continuously extending from the vertical wall 86B in the column direction.

The eighth embodiment sets the width of the slot 86Aa in the row direction to conform to that of the two discharge cells C, but the width of the slot in the row direction can be set at any given value.

The entire surface of the partition wall 86 is covered by an insulation layer 86*a*.

When the partition wall 86 in the eighth embodiment is used for partitioning the discharge space defined between the front glass substrate and the back glass substrate of the PDP into the discharge cells, because of the formation of the slots 86Aa in the transverse walls 86A of the partition wall 86, it is possible to reduce the electrostatic capacity produced in a non-display area of a PDP when a metal-made partition wall is used. This in turn makes it possible to subsequently suppress the occurrence of reactive power during driving of the PDP.

The partition wall of the PDP in each of the first to fifth and eighth embodiments is embodied on the basis of a comprehensively general idea in which: a partition wall made of metal has the external surface covered by an insulation layer and transverse walls each extending in the row direction to define a partition between unit light-emission areas adjacent to each other between two substrates of a PDP in the column direction, and a groove is formed in at least one of a front-facing face and a back face of the transverse wall.

Using the partition wall of the PDP based on the above comprehensively general idea for partitioning a discharge space defined between the front glass substrate and the back substrate of the PDP offers a reduction in the electrostatic capacity which is produced in a non-display area of a PDP when a metal-made partition wall is used, because the grooves are formed in the transverse walls forming part of the partition wall. Hence, reactive power occurring during driving of the PDP is suppressed.

The use of the partition wall offers, in particular, a reduction in the electrostatic capacity produced between the row electrode on the front glass substrate and the column electrode on the back glass substrate which are opposite each other with the discharge space in between to allow for generation of an addressing discharge. As a result, reactive power occurring when the addressing discharge is generated is effectively suppressed.

The structure of the partition wall described above offers the applicability of metal-made partition walls to PDPs.

The partition wall of the PDP in each of the aforementioned sixth and seventh embodiments is embodied on the basis of a comprehensively general idea in which: a partition wall made of metal has the external surface covered by an insulation layer and transverse walls each extending in the row direction to define a partition between unit light-emission areas adjacent to each other between two substrates of a PDP in the column direction, and a belt-shaped dielectric extending in the row direction is mounted integrally on the transverse wall.

Using the partition wall of the PDP based on the above comprehensively general idea for partitioning a discharge space defined between the front glass substrate and the back substrate of the PDP offers a reduction in the electrostatic capacity which is produced in a non-display area of a PDP when a metal-made partition wall is used, because the dielectrics are mounted integrally on the transverse walls of the partition wall. Hence, the occurrence of reactive power during the driving of the PDP is suppressed.

In particular, the electrostatic capacity produced between the row electrode on the front glass substrate and the column electrode on the back glass substrate which are opposite each other with the discharge space in between to allow for generation of an addressing discharge is reduced, thereby effectively suppressing reactive power occurring when the addressing discharge is generated.

The structure of the partition wall described above offers the applicability of a metal-made partition wall to a PDP.

Further, by using the partition wall of the PDP described in the first to fifth and eighth embodiments, an embodiment is structured for a PDP having a metal-made partition wall that is interposed between two substrates and has an external surface covered by an insulation layer, transverse walls for defining the partition between unit light-emission areas adjacent to each other in the column direction, and grooved portions each formed in at least one of the front-facing face and the back face of the transverse wall.

With the above PDP, the grooved portion is formed in the transverse wall of the partition wall partitioning the discharge space defined between the front glass substrate and the back glass substrate into the unit light-emission areas. For this reason, the electrostatic capacity which is produced in a non-display area of a PDP when a metal-made partition wall is used is reduced. Hence, reactive power occurring during driving of the PDP is suppressed.

In particular, the electrostatic capacity produced between the row electrode on the front glass substrate and the column electrode on the back glass substrate which are opposite each other with the discharge space in between to allow for generation of an addressing discharge is reduced, thereby effectively suppressing reactive power occurring when the addressing discharge is generated.

Further, by using the partition wall of the PDP described in the sixth and seventh embodiments, an embodiment is structured for a PDP having a metal-made partition wall that is interposed between two substrates, and has an external surface covered by an insulation layer, transverse walls for defining the partition between unit light-emission areas adjacent to each other in the column direction, and belt-shaped dielectrics each mounted integrally on the transverse wall and extending in the row direction.

With the above PDP, the belt-shaped dielectrics each extending in the row direction are mounted integrally on the partition wall partitioning the discharge space defined between the front glass substrate and the back glass substrate into the unit light-emission areas. For this reason, the electrostatic capacity which is produced in a non-display area of a PDP when a metal-made partition wall is used is reduced, thereby suppressing the occurrence of reactive power during driving of the PDP.

In particular, the electrostatic capacity produced between the row electrode on the front glass substrate and the column electrode on the back glass substrate which are opposite each other with the discharge space in between to allow for generation of an addressing discharge is reduced, thereby effectively suppressing reactive power occurring when the addressing discharge is generated.

The terms and description used herein are set forth by way of illustration only and are not meant as limitations. Those skilled in the art will recognize that numerous variations are possible within the spirit and scope of the invention as defined in the following claims.

What is claimed is:

1. A partition wall for a plasma display panel, comprising:

an insulation layer covering an external surface of the partition wall, the partition wall comprising metal;

a transverse wall extending in a row direction to define a partition between unit light-emission areas adjacent to each other between two substrates of the plasma display panel in a column direction; and a groove portion formed in at least one of a front-facing face and a back face of the transverse wall, wherein a dielectric is fitted into said groove portion, and wherein another groove portion is formed in the other one of the front-facing face and the back face of the transverse wall in which said groove portion with the dielectric fitted therein is not formed.

2. A plasma display panel, comprising:

a partition wall, made of metal, provided between two substrates and having an external surface covered by an insulation layer, a transverse wall extending in a row direction for defining a partition between unit light-emission areas adjacent to each other in a column direction, and a groove portion, which does not pass through the transverse wall from a front-facing face to a back face, formed in at least one of the front-facing face and the back face of the transverse wall.

3. A plasma display panel according to claim 2, wherein said groove portion is formed in the back face of the transverse wall.

4. A plasma display panel according to claim 2, wherein said groove portion is respectively formed in both of the front-facing face and the back face of the transverse wall.

5. A plasma display panel according to claim 2, wherein said groove portion is formed in a configuration extending in the row direction with respect to the transverse wall.

6. A plasma display panel according to claim 2, wherein said groove portion is intermittently formed in the row direction.

7. A plasma display panel according to claim 2, wherein a dielectric is fitted into said groove portion.

8. A plasma display panel according to claim 7, wherein another groove portion is formed in the other one of the front-facing face and the back face of the transverse wall in which said groove portion with the dielectric fitted therein is not formed.

9. A plasma display panel according to claim 2, further comprising a rod-shaped dielectric extending in the row direction and integrally mounted on the transverse wall.

10. A plasma display panel, comprising:

a partition wall, made of metal, provided between two substrates and having an external surface covered by an insulation layer, a transverse wall extending in a row direction for defining a partition between unit light-emission areas adjacent to each other in a column direction, and a groove portion formed in at least one of a front-facing face and a back face of the transverse wall, wherein a dielectric is fitted into said groove portion, and wherein another groove portion is formed in the other one of the front-facing face and the back face of the transverse wall in which said groove portion with the dielectric fitted therein is not formed.

11. A plasma display panel according to claim 10, wherein said groove portion is respectively formed in a configuration extending in the row direction with respect to the transverse wall.

12. A plasma display panel according to claim 11, wherein at least one of said groove portion is intermittently formed in the row direction.

* * * * *